United States Patent [19]

Wilkinson

[11] Patent Number: 4,653,757

[45] Date of Patent: Mar. 31, 1987

[54] GOLF SWING TRAINING APPARATUS

[76] Inventor: Kerry E. Wilkinson, 2827 W. Encanto Blvd., Phoenix, Ariz. 85009

[21] Appl. No.: 847,459

[22] Filed: Apr. 3, 1986

[51] Int. Cl.[4] ..... A63B 69/36

[52] U.S. Cl. ..... 273/191 R; 273/193 A; 273/186 C

[58] Field of Search ..... 273/191 R, 191 B, 192, 273/186 R, 186 A, 191 A, 193 A, 186 C

[56] References Cited

U.S. PATENT DOCUMENTS

| | | | |
|---|---|---|---|
| 3,400,933 | 9/1968 | Heiser | 273/191 R X |
| 3,429,571 | 2/1969 | Abel | 273/191 R X |
| 3,604,712 | 9/1971 | Prior et al. | 273/191 R X |
| 4,486,020 | 12/1984 | Kane et al. | 273/191 R |

*Primary Examiner*—George J. Marlo

*Attorney, Agent, or Firm*—H. Gordon Shields

[57] ABSTRACT

Golf swing training apparatus includes a track mounted on the wall in a vertical orientation with a bracket movable vertically upwardly and downwardly on the track to adjust the height of the apparatus. A rod of a fixed length is secured to the bracket for rotational swiveling and pivoting movement. The end of the rod remote from the bracket is secured to a practice club through a coupling element. The coupling element allows rotational movement of the practice club with respect to the rod, but allows only limited angular motion in a plane which includes the rod and the practice club. The rod includes a bent tip which is substantially perpendicular to the overall length of the rod and the bent tip is maintained in a plane with the coupling element and the practice club throughout the practice swing.

16 Claims, 9 Drawing Figures

FIG. 1
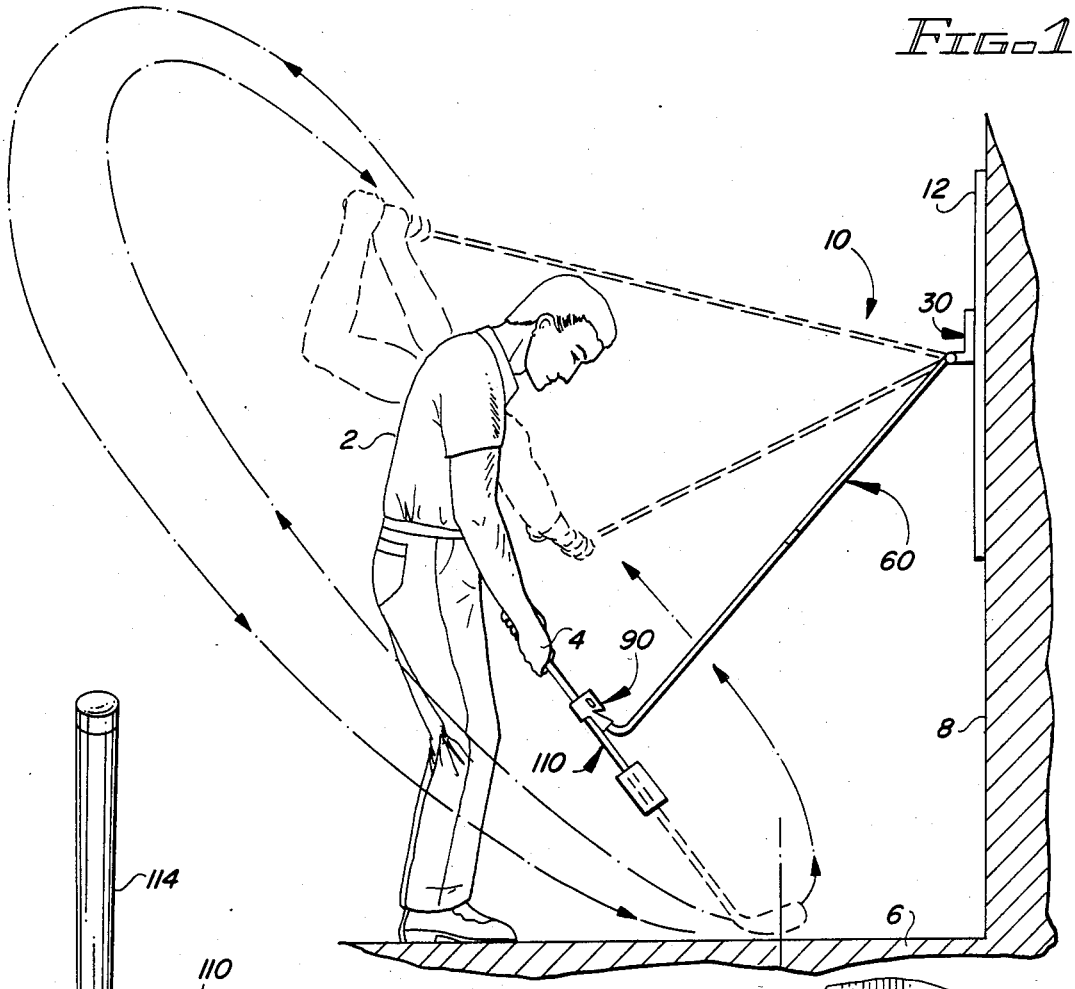
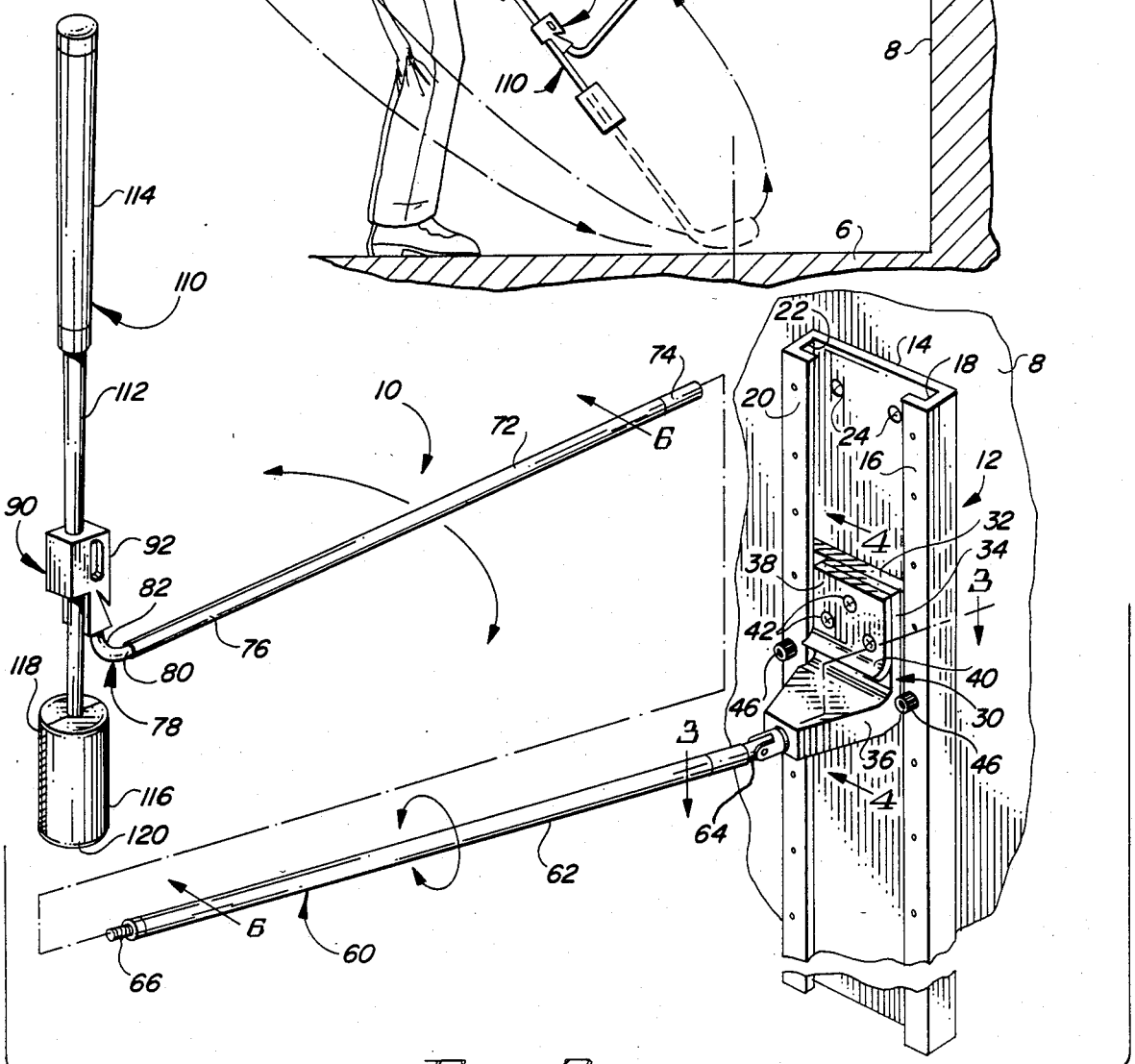
FIG. 2

GOLF SWING TRAINING APPARATUS

BACKGROUND OF THE INVENTION

1. Field of the Invention

This invention relates to golf swing practice apparatus and, more particularly, to golf swing apparatus secured to a fixed surface, such as a wall.

2. Description of the Prior Art

U.S. Pat. No. 4,486,020 discloses golf swing apparatus which includes a suction cup for securing the apparatus to a smooth surface. The apparatus includes a fixed rod rotatably secured to the suction cup and a clamp which secures the rod to a golf club. The clamp is adjustable along the length of the shaft of the golf club. Two embodiments of the clamp are illustrated, one with a ball and socket end of the rod extending into a receptacle within the clamp for allowing the clamp and the rod to rotate relative to each other. There is also a slot to allow for the pivoting of the rod relative to the ball and socket connection. The ball and socket connection is disposed generally parallel to, and spaced apart from, the golf club shaft.

In the second embodiment, the clamp includes a curved aperture extending through the clamp, and the end of the rod is curved on the same radius of curvature as the aperture. The rod includes a compression spring at the very end to bias the rod relative to the clamp.

U.S. Pat. No. 3,604,712 discloses another type of golf practice swing apparatus. The apparatus includes a vertically extending standard with a motion producing arm disposed on the top of the standard. The height of the motion producing arm can be adjusted with respect to the standard. Extending outwardly from the motion producing arm is a motion transmitting system which includes an elongated tube. The tube is adjustable, lengthwise. The tube extends to a motion control system which is in turn secured to a golf club. The motion producing system pivots freely on the standard. The motion transmitting system rotates as the golf club is swung. The apparatus of the U.S. Pat. No. 3,604,712 patent is relatively complicated, particularly as compared to the apparatus of the U.S. Pat. No. 4,486,020.

U.S. Pat. No. 3,429,571 discloses another type of swing training apparatus wihch includes an embodiment designed for use with a golf club. The apparatus includes a ball and socket connection with a rod extending in opposite directions from the ball in the socket. One end of the rod extends to a golf club, and the other end of the rod extends to a gear system movable in the vertical plane and in the horizontal plane through a pair of screw jacks. The rod also rotates through a screw and motor system. Movement is programmed into the system. The user of the apparatus is secured to a hip control unit.

U.S. Pat. No. 3,400,933 discloses another type of golf swing practice apparatus which includes a bracket secured to a post and a rod extending from the bracket downwardly to the head of a golf club. The rod rotates and pivots freely at the bracket. The U.S. Pat. No. 3,400,933 apparatus is relatively simple, while the U.S. Pat. Nos. 3,429,571 and 3,604,712 apparatus are both relatively complicated. The U.S. Pat. No. 4,486,020 apparatus is relatively simple, but it has inherent problems, such as finding a suitable location at which to secure the apparatus. A suction cup is illustrated, and it is extremely difficult to find, in a typical home or apartment or the like, a smooth surface on which to secure a suction cup that will be subject to a substantial amount of stress incurred, or likely to be incurred, during golf practice swings. Obviously, glass is the smoothest surface found in a typical living unit, and the problems inherent in attaching apparatus of this type to a glass surface are legion.

The bracket height in the U.S. Pat. No. 3,400,933 patent is fixed, and can only be adjusted by removing the bracket from the post and affixing it in different locations. Screws are used to secure the bracket. Thus, for golfers of different heights, it will be a relatively inconvenient and time-consuming process to change the height of the bracket. In the U.S. Pat. No. 3,429,571 patent, the ball and socket joint is fixed, and thus may not be vertically adjusted to accommodate users of different heights. In the U.S. Pat. No. 3,604,712 patent, the vertical height may be adjusted, and in the U.S. Pat. No. 4,486,020 patent, the vertical height may also be adjusted.

In the U.S. Pat. No. 4,486,020 patent, the U.S. Pat. No. 3,604,712 patent, and the U.S. Pat. No. 3,429,751 patent, the golf clubs are secured to their respective rods adjacent to the wrapping of the golf club shaft, and accordingly close to the location at which a user grips the shaft. In the U.S. Pat. No. 3,400,933 patent, the rod is secured to the golf club at the head, and thus remote from the location at which the golf club shaft is gripped by the user. The rod is secured to the golf club head merely by means of a tie, and thus the golf club is able to rotate virtually freely with respect to both the rod and the user. In the other patents, the relationship between the respective rods and the golf club shafts is generally controlled.

In the apparatus of the present invention, the height is easily adjusted to accommodate users of different heights. The coupling element between the practice golf club shaft is molded in place and is relatively simple and accordingly relatively inexpensive. The angular relationship between the golf practice club and the rod is determined and is limited within a predetermined range to insure consistency in the apparatus. Moreover, the apparatus is relatively easily installed on virtually any wall or wall surface and is relatively safe and is relatively simple.

SUMMARY OF THE INVENTION

The apparatus described and claimed herein comprises a track secured to a vertical surface with a rod pivoted to a bracket movable on the track and extending to a coupling element secured to a golf practice shaft. The coupling element allows the practice shaft to rotate freely with respect to the rod, but limits the angular movement of the shaft in a plane which includes the practice shaft and the end of the rod.

Among the objects of the present invention are the following:

To provide new and useful golf swing practice apparatus;

To provide new and useful golf practice swing apparatus having a practice golf shaft secured to a rod, with the shaft rotatable relative to the rod;

To provide new and useful golf swing training apparatus having a coupling element between a golf practice shaft and a rod providing limited relative movement in a plane which includes the end of the rod and the shaft;

To provide new and useful golf swing training apparatus having a rod secured to a vertically adjustable bracket to accommodate users of different heights; and To provide new and useful coupling apparatus between a rod and a golf practice shaft which allows relative rotary movement between the shaft and the rod but limited angular movement in a plane which includes the shaft and part of the rod.

BRIEF DESCRIPTION OF THE DRAWINGS

FIG. 1 is a side view illustrating the apparatus of the present invention in its use environment.

FIG. 2 is a perspective view of the apparatus of the present invention.

DESCRIPTION OF THE PREFERRED EMBODIMENT

Figure 3:
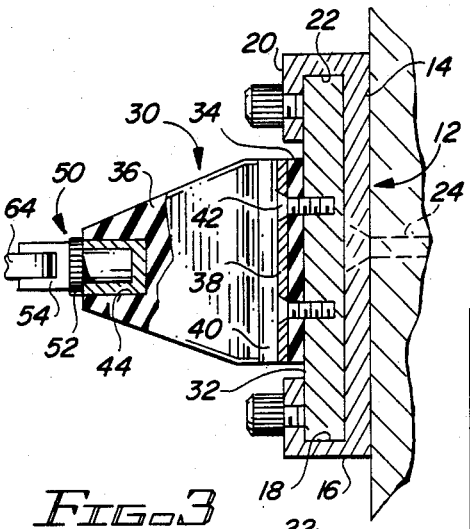
FIG. 3 is a view in partial section taken generally along line 3—3 of FIG. 2.

FIG. 1 is a side view of a person 2 using golf swing training apparatus 10 of the present invention. The person, or user, is standing on a floor 6 adjacent to a wall 8. The wall 8 extends upwardly from the floor 6. The person 2 is located at a convenient distance from the wall 8, and is generally facing the wall 8, while using the golf swing training apparatus 10 of the present invention.

The golf swing apparatus 10 of the present invention includes a track 12 which is secured to the wall 8, a bracket 30 which is movably secured to the track 12, a rod 60, which extends from the bracket outwardly toward a coupling element 90, and a shaft assembly 110. The shaft assembly 110 is in turn held by the user 2, and specifically by hands 4 of the user 2.

FIG. 2 is a perspective view of the golf swing practice apparatus 10 of the present invention showing the track 12 secured to the wall 8, and the bracket 30 in turn secured to the track 12. The rod 60 is shown extending outwardly from the bracket 30. The rod 60 includes two portions, an upper portion 62 which is secured directly to the bracket 30, and a lower portion 72, which is secured to the upper portion and which extends to the coupling element 90.

The shaft assembly 110 includes a shaft 112, a handle 114, and a weight 116. The handle 114 is at one end of the shaft 112, and the weight or counterweight 116 is at the opposite end of the shaft 112 from the handle 114.

Figure 4:
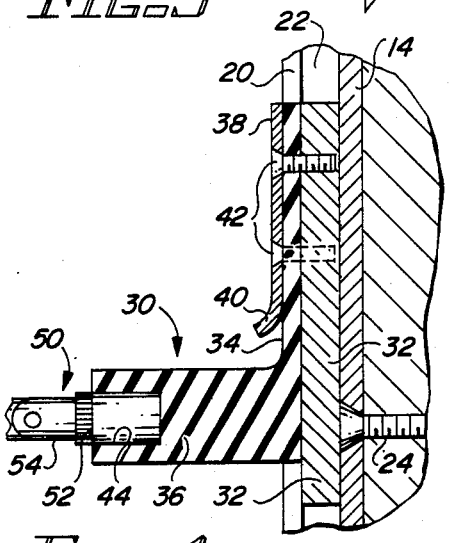
FIG. 4 is a view in partial section taken generally along line 4—4 of FIG. 2.

Details of the track 12 and the bracket 30 are illustrated in FIGS. 3 and 4. FIG. 3 is a top view in partial section taken generally along line 3—3 of FIG. 2 through the track 12 and the bracket 30. FIG. 4 is a view in partial section taken generally along line 4—4 of FIG. 2, also through the track 12 and the bracket 30. FIGS. 3 and 4 are taken generally at right angles to each other.

Figure 5:
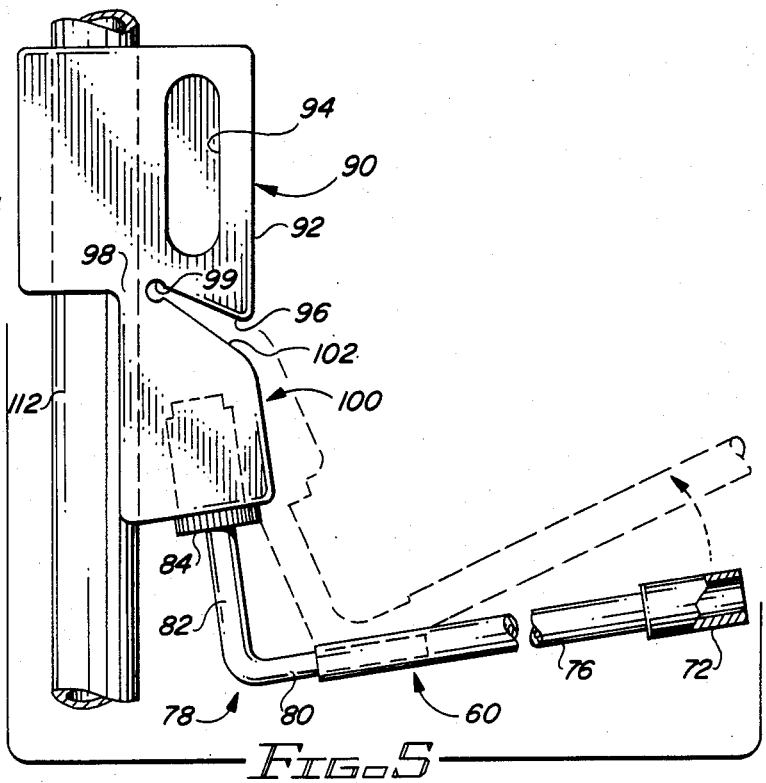
FIG. 5 is an enlarged view of a portion of the apparatus of the present invention.

Details of the coupling element 90 and the rod 60 are shown in FIGS. 5, 6, 7, 8, and 9. FIG. 5 is an enlarged side view of the coupling element 90 and the portion of the rod 62 adjacent to and connected with the coupling element 90.

Figure 6:
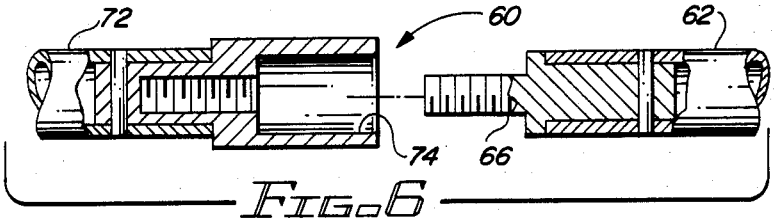
FIG. 6 is a view in partial section taken generally along line 6—6 of FIG. 2.

FIG. 6 is a view in partial section taken generally along line 6—6 of FIG. 2, illustrating the securing together of the upper portion 62 and the lower portion 72 of the rod 60.

Figure 7:
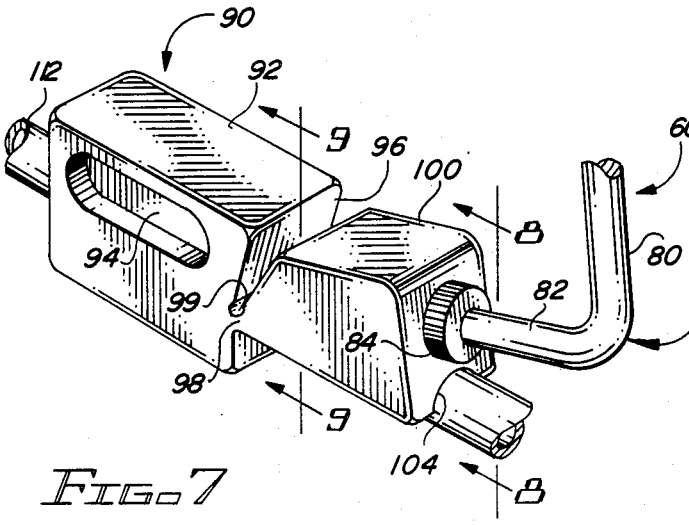
FIG. 7 is a perspective view of a portion of the apparatus of the present invention.
Figure 8:
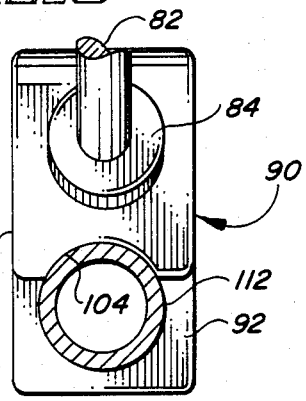
FIG. 8 is a view in partial section taken generally along line 8—8 of FIG. 7.
Figure 9:
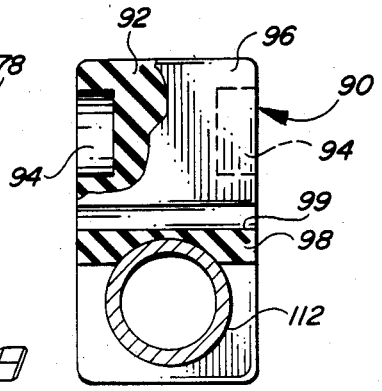
FIG. 9 is a view in partial section of the apparatus of FIG. 7 taken generally along line 9—9 of FIG. 7.

FIG. 7 is a perspective view of the coupling element 90 and the adjacent portions of the shaft 112 and of the rod 60. FIGS. 8 and 9 are views in partial section, taken generally along lines 8—8 and 9—9 of FIG. 7, respectively, through the coupling element 90 and related or associated elements.

For the following discussion of the practice golf swing apparatus 10 of the present invention, reference will be made generally to all of the Figures, and specifically to individual Figures as applicable.

Referring generally to FIGS. 2, 3 and 4, the track 12 is shown secured to the wall 8 by the direct securement of a base or base plate 14 to the wall 8 by a plurality of fasteners 24, which may typically be screws, or the like. The type of fastener used will depend in part or in large measure on the type of wall to whch the track 12 is secured. If the track 12 is secured to a wooden wall, for example, then wood screws may be appropriately used to secure the base 14 to the wall. If the wall 8 is made of typical wall board (gypsum board) then perhaps more sturdy fasteners, such as toggle bolts, etc., may be required.

Secured to the base 14 are a pair of inwardly extending L-shaped arms or flanges 16 and 20. The flanges extend generally outwardly from the plate 14 toward each other and define a pair of grooves 18 and 22. The flanges 16 and 20 are generally "L" shaped, with one arm extending substantially perpendicularly outwardly from one edge of the base 14 and the other arm extending inwardly generally parallel to the base 14. The flange 20 is substantially identical, but comprises a virtual mirror image of the flange 16. Thus, the flange 16 and the flange 20 include arms which are generally aligned with each other and facing each other so that their respective included grooves 18 and 22 are also facing each other.

The bracket 30 includes a back plate 32 which is disposed within the grooves 18 and 22 and generally against the base 14 of the track 12. Secured to the back plate 32 is a generally "L" shaped element including a vertically extending arm 34 and a horizontally extending arm 36. The vertically extending arm 34 is appropriately secured to the plate 32. The horizontally extending arm 36 extends outwardly from the plate 32 and from the vertical arm 34. The arms 34 and 36 are preferably made of a flexible material, or a yieldable material, such as rubber. The arm elements 34 and 36 should not be rigid, but should not also be floppy. They should be relatively hard, and yet elastic enough to move or flex as required under the stress of the swing of the user 2. The movement of the horizontal arm 36 is primarily vertical movement or flexing relative to the vertical arm 34.

A plate 38 is used to secure the vertical arm portion 34 to the back plate 32. The plate 38 includes a lower lip 40 which is curved adjacent to the horizontal arm 36 to avoid cutting the arm 36, or in any other way damaging the arm 36, as the arm 36 flexes or pivots upwardly and downwardly. The lower lip 40 terminates upwardly from the juncture of the arms 34 and 36 to minimize contact between the arm 36 and the plate 38. A plurality of fasteners 42, which may be screws, etc., are used to secure the plate 38 and the vertical arm 34 to the back plate 32.

At the front of the horizontal arm 36 is a socket 44. A swivel element 50, well known and understood in the art, extends into the socket 44 and is appropriately secured therein. The swivel element 50 includes a cup 52, which extends into the socket 44, and a yoke 54, which swivels or rotates relative to the cup 52. The yoke 54 is a bifurcated element which receives a tongue 64 of the upper portion 62 of the rod 60.

The rod 60, best shown in FIGS. 1 and 2, and additional details of which are shown in the other Figures in the drawing, includes the two primary, elongated portions 62 and 72. The upper portion 62 includes the tongue 54 on one end, and an exteriorally threaded shank 66 at its opposite end, remote from the tongue 64. The tongue 64, as indicated above, is appropriately secured, as by a pin arrangement, to the yoke 54 of the swivel element 50.

The lower portion 72 of the rod 60 includes a socket 74, which has an interiorally threaded portion at one end and a coupling socket 76 at its opposite end. The interiorally threaded socket 74 receives the exteriorally threaded shank 66 to secure the upper portion 62 and the lower portion 72 together. The rod 60, as comprising the upper portion 62 and the lower portion 72, is relatively rigid, but it swivels freely on the bracket 30 through the swivel element 50.

A pin 78, bent into a generally "L" shape, is secured to, and extends between, the coupling socket 76 and the coupling element 90. The "L" shaped pin 78 includes two arms, an arm 80 and an arm 82. The arm 80 extends into and is secured to the coupling socket 76, and the arm 82 is secured to a coupling socket 84 at the coupling element 90.

The "L" shaped pin 78 swivels freely with respect to both the rod 60 and the coupling element 90. The rod 60 in turn swivels freely with respect to the bracket 30. However, the rod 60 is fixed in length between the bracket 30 and the pin 80.

The coupling element 90 is best illustrated in FIGS. 5, 7, 8, and 9. Reference to FIGS. 1 and 2 may also be advantageous in understanding the structure and function of the coupling element 90.

The coupling element 90 includes two primary portions, a shaft coupling block portion 92 and a rod coupling portion 100. The shaft coupling block portion 92 is appropriately secured to the shaft 112 of the shaft assembly 110. The shaft coupling block portion 92 is preferably molded directly onto the shaft 112 to prevent longitudinal movement of the block 92 with respect to the shaft 112. Under some circumstances, it may be advantageous to pin the block 92 to the shaft 112.

A pair of recesses 94 are disposed on opposite sides of the coupling block 92 generally parallel to the shaft 112. The recesses are used to help provide a uniform block and to help conserve material, or to not waste material. They serve generally no other functional purpose.

If desired, the coupling block 92 may be of a generally round or cylindrical configuration, instead of the block configuration illustrated. Again, such round or oval configuration may be advantageous with respect to the economics of manufacture, etc.

The shaft coupling block portion 92 includes a front face 96 which extends upwardly from an integral or living hinge 98 which connects the shaft coupling block portion 92 and the rod coupling portion 100 together.

As best shown in FIG. 5, the face 96 is disposed at an acute angle with respect to the longitudinal axis of the shaft 112, measuring from the shaft 112 upwardly to the face 96. The rod coupling portion 100 includes a rear face 102 which extends at an acute angle with respect to the longitudinal axis of the shaft 112, also measuring upwardly from the shaft 112 and through the rod coupling portion 100 to the face 102. There is preferably an angular difference of about twelve degrees between the faces 96 and 102. This allows the rod coupling portion 100 to move a maximum of about twelve degrees with respect to the longitudinal axis of the shaft 112. This twelve degrees is the maximum allowed movement of the shaft 112 with respect to the rod 60 during the practice swing of the user 2. This is illustrated in dotted line (phantom) in FIG. 5.

A circular relief aperture of hole 99 extends laterally through the coupling element 90 through the hinge 98 and at the juncture of the faces 96 and 102. The hole prevents a strain on the hinge 98 as the portion 100 moves relative to the portion 92. It also allows the faces 96 and 102 to abut or contact each other without undue interference because of the hinge 98.

A rod coupling portion 100 includes a groove 104. The shaft 112 extends into the groove 104 to limit the "downward" movement of the rod coupling portion 100 with respect to the shaft 112. The abutting of the faces 96 and 102 limits the "upward" movement of the rod coupling portion 100 with respect to the shaft 112. This is shown in dotted line in FIG. 5.

Referring now to FIG. 1, the golf swing practice apparatus 10 of the present invention may be used by a male or female player of virtually any height. The track 12 is first appropriately secured to a wall 8 at a convenient height, considering the height of the user(s) of the apparatus. Obviously, the track 12 should be located far enough away from adjacent side walls so that there is no danger of the apparatus contacting furniture, a wall, etc., while the user 2 engages in practice swings.

The bracket 30 is appropriately adjusted vertically with respect to the track 12 by means of a plurality of adjusting elements 46. (See FIG. 2.) The bracket 30 is preferably located at about eye level of the user 2. With the bracket 30 in place on the track 12, the two portions 62 and 72 of the rod 60 are secured together.

Next, the user 2 gets into position relative to the bracket 30. This is done by holding the shaft 112 substantially perpendicularly to the rod 60 at waist height, with the rod 60 in a plane substantially perpendicular to the plane of the track 12 (or the base 14, the plate 38, etc.). The user 2 then walks forward until the shaft 112 is contacted. The user 2 is then at the correct distance from the wall 8 and/or from the bracket 30.

As practice swings are made by a user 2, the pivoting of the rod 60 at both the bracket 30 and the coupling element 90, by means of the respective swivel elements 50 and 84, allows the user 2 to swing the shaft assembly 110, and particularly the shaft 112, by holding the handle 114, in practice swings. The back swing and the follow through are an integral part of the swing, and they are controlled by means of the apparatus 10 as the user 2 swings. The control comes by virtue of the rod 60, the bracket 30, and the coupling element 90 as secured to the shaft assembly 110.

As practice swings are made, the relationship of the rod, fixing the distance between the shaft 112 and the bracket 30, limits or substantially defines the arc through which the shaft 112 moves. The angular relationship between the shaft 112 and the rod 60 is relatively fixed through the pin 78 and the rod coupling portion or element 100. The arms 80 and 82 of the pin 78 are substantially perpendicular to each other, and the arm 80 is generally aligned parallel to, and concentric with, the rod 60, as may best be seen from FIG. 5.

The movement of the shaft 112 relative to the rod 60, is limited, as illustrated in FIG. 5, to about twelve degrees between the respective faces 96 and 102 of the shaft coupling block or portion 92 and the rod coupling portion 100. This is also best shown in FIG. 5. With the rod coupling portion 100 disposed on the shaft 112, by means of the shaft 112 extending into the groove 104, and a twelve degree separation between the faces 96 and 102, the rod coupling block portion or element 100 moves only about that twelve degrees, maximum, until the faces 96 and 102 abut each other. This angular movement is, of course, in a plane which includes the shaft 112, the coupling element 90, and the arms 80 and 82 of the pin 78 and the rod 60.

It will be noted, as discussed above, and as best illustrated in FIGS. 2, 3, and 4, that the rod 60 both pivots and rotates freely with respect to the arm 36 of the bracket 30. The rod 60 also rotates freely with respect to the shaft assembly 110 and the coupling element 90, but the pivoting or angular motion is limited or determined by the angular relationship between the faces 96 and 102, as discussed above.

Also as discussed above, there is a slight vertical movement of the arm 36 relative to the arm 34 of the bracket 30. Additionally, there may be a slight lateral movement of the arm 36 due to the inherent flexibility of the material out of which the bracket 30 is made. However, such lateral movement is very slight.

In FIGS. 1, 2, 3, and 4, the track 12 is illustrated as secured to a wall 8. It is obvious that the track 12 may be secured to any generally vertically extending element, such as a post, or the like, as desirable or as available. Thus, if the practice swing apparatus 10 is used out of doors, on a patio, etc., a post or other generally vertically extending fixture may be used to support the practice apparatus 10. Inside, a wall is perhaps the most convenient element or surface on which to secure the track 12.

Also, if desired, as when the apparatus 10 will be used for only a single user, or by individuals of about the same height, the track 12 and its associated elements may be eliminated. The bracket 30 may then be fixed in place, as on a wall, post, etc.

Additional swing feedback to a user 2 may be accomplished by having the weight 116 divided into two colored portions, as for example, a black portion 118 and a white portion 120. The color differentiation should be in a plane that intersects the weight 116 longitudinally and symmetrically with respect to the shaft 112 and to the coupling element 90. The color differentiation essentially divides the weight symmetrically into two halves.

When the handle 114 is correctly gripped, and the user 2 is standing correctly, with the plane of the rod 60 and the shaft 112 substantially perpendicular to the plane of the wall 8, or to the plate 14, the plate 32, etc., the user 2 should see the colored portions 118 and 120 of the weight 116 in equal amounts. If the colors are not seen equally initially, as in "addressing the ball" prior to taking a practice swing, a correction should be made. The user 2 should also see both colors equally during the swing.

The color differentiation should preferably be such that the different colors are easily observed and discerned by the user 2, not only by direct vision, as while in the initial addressing position, but also by peripheral vision, as while swinging. Having two colors enhances the user of the practice apparatus 10 by providing positive feedback to the user 2.

While the principles of the invention have been made clear in illustrative embodiments, there will be immediately obvious to those skilled in the art many modifications of structure, arrangements, proportions, the elements, materials, and components used in the practice of the invention, and otherwise, which are particularly adapted for specific environments and operative requirements without departing from those principles. The appended claims are intended to cover and embrace any and all such modifications, within the limits only of the true spirit and scope of the invention. This specification and the appended claims have been prepared in accordance with the applicable patent laws and the rules promulgated under the authority thereof.

What I claim is:

1. Golf swing practice apparatus, comprising, in combination:

practice shaft means for practicing a golf swing by a user;

rod means, including a first end secured to the practice shaft means and a second end remote from the first end;

bracket means for holding the second end of the rod means at a fixed location while the user practices a golf swing; and coupling means for securing the first end of the rod means to the practice shaft, including a shaft coupling portion secured to the practice shaft means, a rod coupling portion secured to the first end of the rod, and hinge means for connecting the shaft coupling portion to the rod coupling portion and for allowing the rod coupling portion to pivot relative to the shaft coupling portion.

2. The apparatus of claim 1 in which the shaft coupling portion includes a first face adjacent to the hinge means, and the rod coupling portion includes a second face adjacent to the hinge means and to the first face, and the first and second faces limit the angular movement of the rod means relative to the practice shaft means in a plane which includes the practice shaft means and at least a portion of the rod means.

3. The apparatus of claim 2 in which the rod means includes a pin secured to the first end of the rod means and to the rod coupling portion for securing the rod means to the coupling means.

4. The apparatus of claim 3 in which the pin includes a first arm and a second arm, and the first and second arms are disposed at substantially right angles to each other.

5. The apparatus of claim 1 in which the coupling means further includes a second swivel means secured to the rod coupling portion and to the first end of the rod means for allowing the rod means to swivel relative to the coupling means during a practice swing.

6. The apparatus of claim 5 in which the rod means further includes a first arm connected to the second swivel means and a second arm connected to the first arm and extending substantially perpendicularly thereto and connected to the first end for maintaining the rod means in a predetermined angular relationship to the practice shaft means.

7. The apparatus of claim 1 in which the practice shaft means includes a shaft, a handle secured to the shaft for a user to hold while practicing a golf swing, a weight secured to the shaft remote from the handle, and the coupling means is secured to the shaft between the handle and the weight.

8. The apparatus of claim 7 in which the rod coupling portion of the coupling means includes a groove for receiving the shaft for limiting the pivoting of the rod coupling portion and the rod means relative to the shaft and the shaft coupling portion.

9. The apparatus of claim 8 in which the shaft coupling portion is fixedly secured to the shaft and the shaft coupling portion includes a first face adjacent to the hinge means.

10. The apparatus of claim 9 in which the rod coupling portion includes a second face adjacent to the hinge means and to the first face of the shaft coupling portion, and the rod coupling portion pivots between the shaft and the shaft coupling portion, and the pivoting is limited by the angular relationship between the first and second faces.

11. The apparatus of claim 1 in which the bracket means includes a track securable to a generally vertically extending surface and a bracket movable in the track and secured to the second end of the rod means and adjustable relative to the track for varying the height at which the second end of the rod means is held.

12. The apparatus of claim 11 in which the bracket of the bracket means includes:

a back plate movable relative to the track, a first bracket arm secured to the back plate, and a second bracket arm secured to the first arm and extending outwardly therefrom, and the second end of the rod means is secured to the second arm.

13. The apparatus of claim 12 in which the second arm flexes relative to the first arm.

14. The apparatus of claim 11 in which the bracket means further includes first swivel means for securing the second end of the rod means to the bracket for allowing the rod means to swivel relative to the bracket as the rod means is held by the bracket during a practice swing.

15. The apparatus of claim 1 in which the practice shaft means includes a shaft and a weight, and the weight is divided into at least two portions observable by the user.

16. The apparatus of claim 15 in which the two portions are colored differently for ease of differentiation and observation.

* * * * *